US007168980B2

(12) United States Patent
Peng

(10) Patent No.: US 7,168,980 B2
(45) Date of Patent: Jan. 30, 2007

(54) COAXIAL CONNECTOR

(75) Inventor: Robert Peng, Jhonghe (TW)

(73) Assignee: F-Time Technology Industrial Co., Ltd., Jhonghe (TW)

( * ) Notice: Subject to any disclaimer, the term of this patent is extended or adjusted under 35 U.S.C. 154(b) by 0 days.

(21) Appl. No.: 11/431,574

(22) Filed: May 11, 2006

(65) Prior Publication Data

US 2006/0264100 A1 Nov. 23, 2006

(51) Int. Cl.
*H01R 9/05* (2006.01)

(52) U.S. Cl. ..... 439/580

(58) Field of Classification Search ..... 439/578–581
See application file for complete search history.

(56) References Cited

U.S. PATENT DOCUMENTS 6,547,592 B2 * 4/2003 Boillot ..... 439/578

* cited by examiner

*Primary Examiner*—Javaid H. Nasri
(74) *Attorney, Agent, or Firm*—Bacon & Thomas, PLLC

(57) ABSTRACT

A coaxial connector has a strong structure to avoid structural distortion and looseness comprising a housing, a sliding support, an electric conducting block, a first conducting rod assembly, a first sealing support, a second conducting rod assembly, a second sealing support, a contact piece and a third sealing support, which takes an advantage of good electrical connection formed between the contact piece and the first conducting rod assembly through the electric conducting block to enhance the signal transmission function and to obtain a stable signal without distortion when the coaxial connector is switched from one direction to another direction to transmit signal.

4 Claims, 3 Drawing Sheets

COAXIAL CONNECTOR

BACKGROUND OF THE INVENTION

1. Field of the Invention

The invention relates to a coaxial connector, more particularly to a coaxial connector with structural improvement capable of switching the transmission direction of electronic signal.

2. Description of Prior Art

Normally most of the conventional type connector can allow the electronic signal to be transmitted in only one direction. However there is also a coaxial connector for the aerial module of wireless local area network system which possesses the function of switching of the direction of signal transmission, and allows switching and changing the direction of signal transmission when the signal is transmitted through the connector.

Shown in FIGS. 1 and 2 is the structure of the conventional connector 10 which comprises a metal housing 11 forming grounding of the system with inner space arranged as switching control compartment 111 and butt connection opening 112, an axial sliding support 13 and first sealing support 14 installed on both ends of the switching control compartment 111 for holding the conducting rod assembly 12 inside the switching control compartment 111.

The conducting rod assembly 12 comprises a movable conducting rod 121, a fixed conducting rod 122 and an elastic restoring mechanism 123, and by arranging the elastic restoring mechanism 123 between the movable conducting rod 121 and the fixed conducting rod 122 a movable connection with elastic restoring mechanism is formed.

Moreover, the conducting rod assembly 12 is installed inside the switch control compartment 111 of the metal housing 11 in such a way that the movable conducting rod 12 is supported by, and can freely move inside the center hole of the axial sliding support 13 with its front part extended into the butt connection opening of the metal housing 11 to form the axially-movable signal input end of the conventional type coaxial connector 10, and the fixed conducting rod 122 of the conducting rod assembly 12 is supported, and secured by the first sealing support 14 to form fixed state with its front part extended to the outside of the conventional type coaxial connector to form signal output end.

This type of conventional coaxial connector 10 also has a contact pin 15 which, by employing the second sealing support 16, has its upper part extended to the outside of the conventional type coaxial connector 10 to form another signal input end of the conventional type coaxial connector 10 while the lower part of the contact pin 15 extends to the inside of the switching control compartment 111 of the metal housing 11 to form electric contact with the conducting rod assembly 12.

This type of conventional coaxial connector has two ways of electric signal transmission. When there is no complementary connector 19 connected to the input end of the conventional coaxial connector 10 as shown in FIG. 1, the contact pin 15 and the conducting rod assembly 12 form electric connection, signal is transmitted from contact pin 15 to the fixed conducting rod 122. However, when a complementary connector 19 is connected to the signal input end as shown in FIG. 2, the movable conducting rod 121 is pushed by the complementary conductor 19, and moves backwardly that caused electric disconnection between the contact pin 15 and the conducting rod assembly 12, and the signal is transmitted from the complementary connector 19 to the fixed conducting rod 122 through movable conducting rod 121. By these ways the conventional type coaxial connector 10 has the function of switching the direction of signal transmission.

However, owing to the drawback of poor structure strength caused by extending the contact pin 15 into the switching control compartment 111 of the metal housing 11 in the way of cantilever which is frequently bumped or pushed by the elastic restoring mechanism 123 of the conducting rod assembly 12 that always results in the damage of distortion and looseness of the contact pin 15, particularly since the electric contact between the contact pin 15 and the conducting rod assembly 12 is in the form of cylindrical surface to flat surface which has a very small contact area, it always results in poor electrical connection quality, moreover, since the contact pin 15 is apt to distortion or looseness that will cause the drawbacks of unstable signal transmission and distorted signal of the conventional type coaxial connector 10. In view of these drawbacks it is necessary to do further improvement of the conventional type coaxial connector 10.

SUMMARY OF THE INVENTION

In view of the above the major purpose of the invention is to provide an improvement of the structure of coaxial connector which comprises a housing, a sliding support, an electric conducting block, a first conducting rod assembly, a first sealing support, a second conducting rod assembly, a second sealing support, a contact piece and a third sealing support, particularly, by adopting the electric conducting block in the structure a flat-surface to flat-surface contact between the bottom side of the contact piece and the top side of the electric conducting block can be achieved that can also enable a more strong structure of the contact piece of the coaxial connector without being apt to the damage of distortion or looseness. Besides, since both of the side surfaces of the electric conducting block are flat surface, a good electric connection between electric conducting block and the first conducting rod assembly, as well as the contact piece can be achieved, and the damage of distortion or looseness of the contact piece caused by bumping and impact by the first conducting rod can be avoided, so that the performance of signal transmission of the coaxial connector can be enhanced and more stable signal transmission and switching without signal distortion can be obtained.

DETAILED DESCRIPTION OF THE PREFERRED EMBODIMENTS

Figure 1:
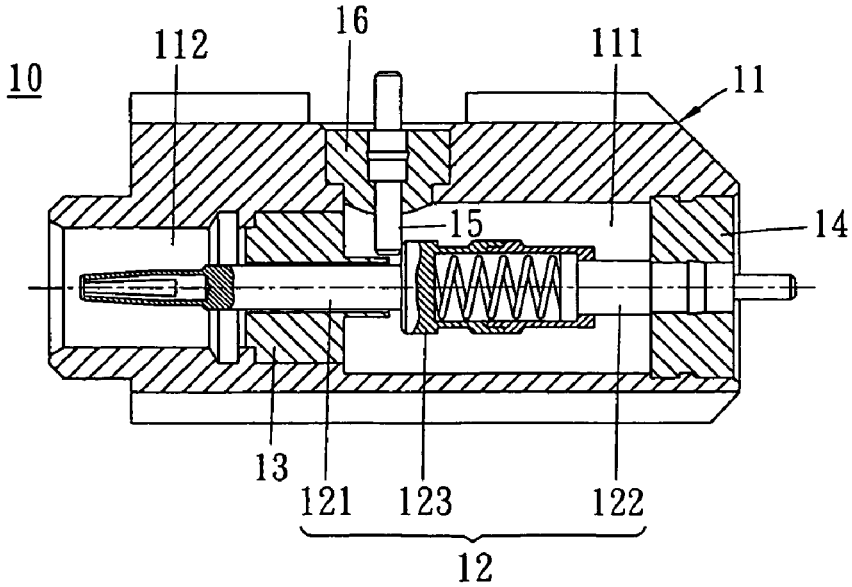
Fig. 1 (prior art)
FIG. 1 is the sectional view along the longitudinal axis of the conventional type coaxial connector showing the structure of the connector.
Figure 2:
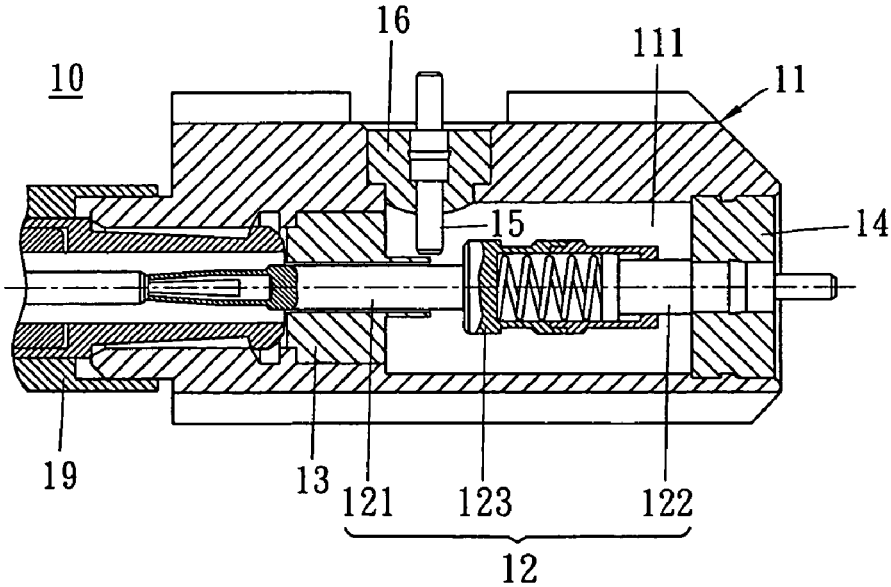
Fig. 2 (prior art)
FIG. 2 is the sectional view along the longitudinal axis of the conventional type coaxial connector connected to a complementary connector showing that the conventional coaxial connector possesses the function of switching the direction of signal transmission through the coaxial connector.
Figure 3:
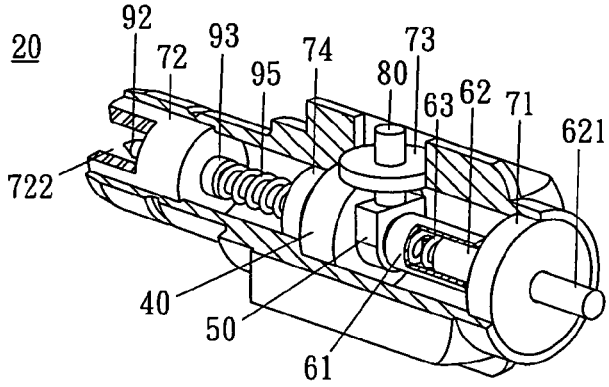
FIG. 3 is the three-dimensional partial sectional view of the coaxial connector of the invention.
Figure 4:
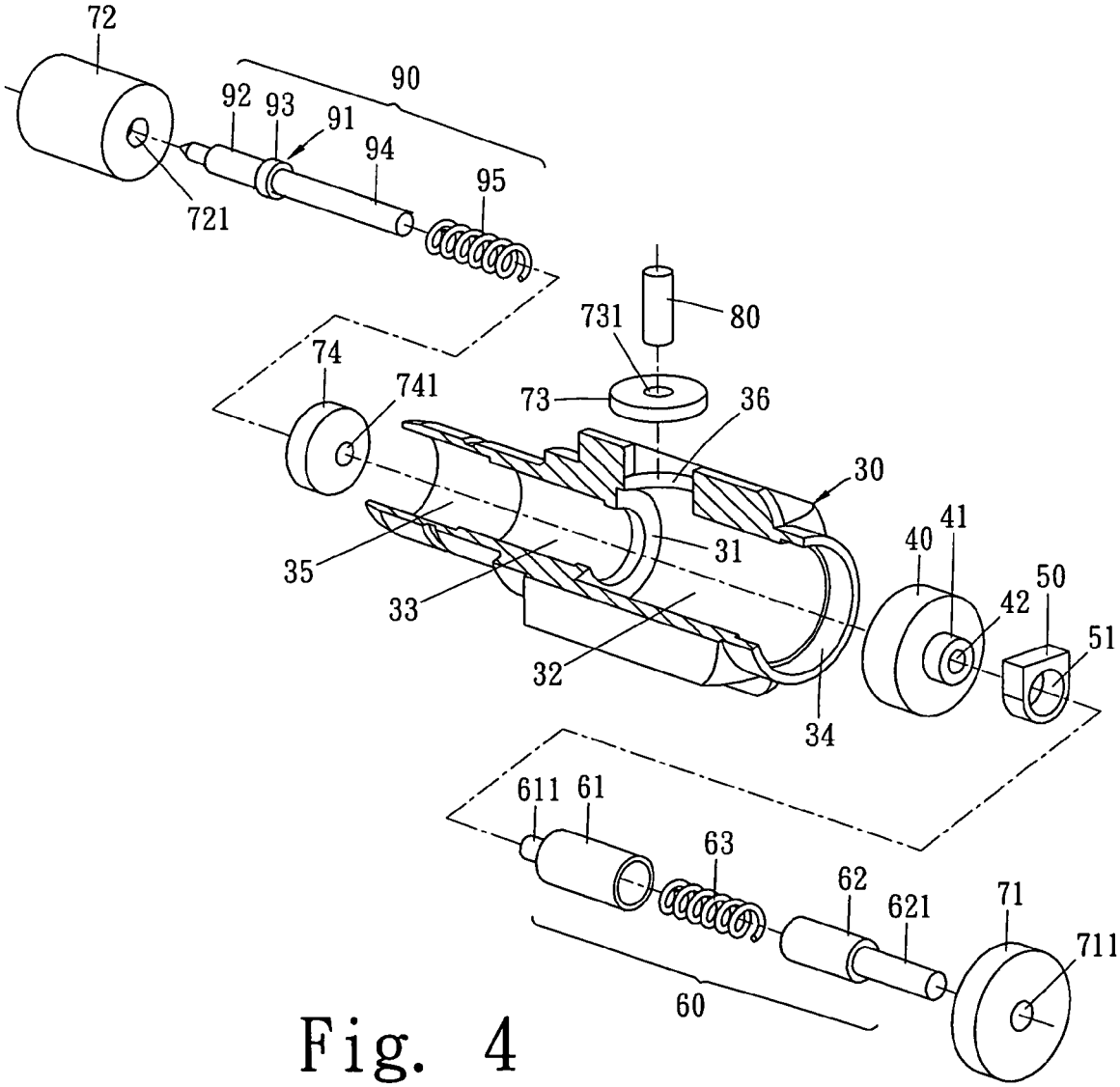
FIG. 4 is the disassembly drawing of the coaxial connector shown in FIG. 3 showing the parts and the interrelation between parts.

Referring to FIGS. 3 and 4, the coaxial connector 20 of the invention having the function of switching the direction of signal transmission comprises a housing 30, a sliding support 40, an electric conducting block 50, a first conducting rod assembly 60, a first sealing support 71, a second conducting rod assembly 90, a second sealing support 72, a contact piece 80 and a third sealing support 73. However, the more preferred embodiment of the invention is to further include a bearing piece 74 in the structure of the present invention.

Figure 7:
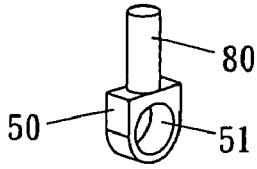
FIG. 7 is the schematic drawing of the electric conducting block and the contact piece which are integrally formed into a whole piece.

And, another preferred embodiment of the invention as shown in FIG. 7 is to have the electric conducting block 50 and the contact piece 80 integrally combined into a whole piece.

The housing 30 of the coaxial connector 20 is made of metal which can form the grounding, and is made to have a hollow inner side with a circular rib 31 formed on the inner wall of the inner space perpendicular to the axis of the coaxial connector to divide inner space into two compartments of the first cylindrical chamber 32 and the second cylindrical chamber 33 which are connected and adjacent to each other.

In addition, an outlet opening 36 is formed on the wall of the first cylindrical chamber 32 of the housing 30 near the circular rib 31, and can communicate with the first cylindrical chamber 32.

As shown in FIG. 3, all the parts of sliding support 40, electric conducting block 50 and first conducting rod assembly 60 are installed in the first cylindrical chamber 32 of the housing 30 in sequence. Also, at the main outlet of the first cylindrical chamber 32 a sealing portion 34 is formed with inside diameter greater than the inside diameter of the first cylindrical chamber 32 for tightly installing and holding the first sealing support 71 which has a center hole 711 and for sealing the main outlet of the first cylindrical space 32.

Similarly, the parts of bearing piece 74, second conducting rod assembly 90 are installed in the second cylindrical chamber 33 of the housing 30 in sequence. Also, at the main outlet of the second cylindrical space a sealing portion 35 is formed with inside diameter greater than the inside diameter of the second cylindrical chamber 33 for tightly installing and holding the second sealing support 72 which has a center hole 721, and for sealing the main outlet of the second cylindrical chamber 33.

At the outlet opening 36 the third sealing support 73 having a center hole 731 is tightly installed and held for sealing the outlet opening 36, and by employing the center hole 731 the contact piece 80 is installed and held with its front portion extended to the outside of the coaxial connector 20 to form the signal input end of the coaxial connector 20 and its back portion extended into the first cylindrical chamber 32 of the housing 30 of the coaxial connector 20.

The sliding support 40 is an electric insulating part, and is securely installed and fixed inside the first cylindrical chamber 32 against the circular rib 31 inside the housing 30, and on one side of the sliding support 40 a raised hub 41 is formed for installing and fixing the electric conducting block 50, in addition, the sliding support 40 has a sliding center hole 42 for accommodating the center rod 611 of the first conducting rod assembly 60 and the push rod 94 of the second conducting rod assembly 90, and for allowing the center rod 611 and the push rod 94 to move freely in axial direction in the sliding center hole 42.

Figure 5:
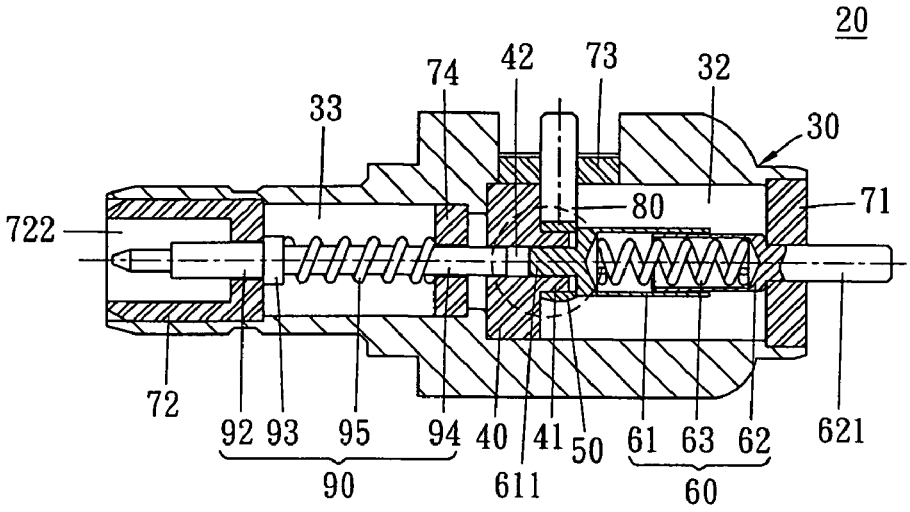
FIG. 5 is the sectional structure drawing along the longitudinal axis of the coaxial connector of the invention.

Referring to FIGS. 3 to 5, the electric conducting block 50 is made of metal, and has a mounting hole 51 for fitting the raised hub 41 of the sliding support 40, so that the electric conducting block 50 can be installed on the raised hub 41. Since the top side of the electric conducting block 50 is a flat surface so that the flat bottom side of the contact piece 80 inside the first cylindrical chamber 32 of the housing 30 can evenly touch the flat top side of the electric conducting block to form flat-surface to flat-surface contact which enables a good electrical connection. Particularly, since both of the left and right side of the electric conducting block 50 perpendicular to the center axis of the sliding center hole 42 are also flat surface, a flat-surface to flat-surface contact between the side surface of the electric conducting block 50 and the moveable cylinder 61 of the first conducting rod assembly 60 can be achieved to enable a good electrical connection. In addition, with this type of structure the damage of distortion or looseness of the contact piece 80 due to the bumping or impact by the movable cylinder 61 of the first conducting rod assembly 60 can be avoided, and more effective signal transmission function of the coaxial connector 20 without signal distortion can be achieved.

Shown in FIG. 7 is one of the example of the preferred embodiment of the invention which has the contact piece 80 formed directly on the top side of the electric conducting block 50 to combine these two parts integrally as a whole piece structure. When the electric conducting block 50 is installed on the raised huh 41, distortion or looseness of the contact piece 80 shall never occur when pushed and bumped by the first conducting rod assembly 60, and therefore can achieve a superior electrical connection.

The first conducting rod assembly 60 comprises a movable cylinder 61, a fixed cylinder 62 and a spring 63 which form a movably connected elastic restoring mechanism by mounting the spring 63 between the movable cylinder 61 and the fixed cylinder 62.

As shown in FIGS. 4 and 5, a center rod 611 is formed axially on the outer side of the movable cylinder 61, and extends freely into the sliding center hole 42, so that one end of the first conducting rod assembly 60 can be supported by the sliding support 40 by having the center rod 611 fitted into the sliding support 40.

Similarly, the conducting rod 621 is formed on the outer end of the fixed cylinder 62, and is fitted into the center hole 711 on the first sealing block 71 when the first conducting rod assembly 60 is installed in the first cylindrical chamber 32 of the housing 30, and the first sealing block 71 is tightly fitted and mounted into the sealing portion 34 of the first cylindrical chamber 32 of the housing 30, so that the first conducting rod assembly 60 can be supported by the first sealing support 71 by means of fitting the conducting rod 621 into the center hole 711 on the first sealing support 71. And, the end portion of the conducting rod 621 of the first conducting rod assembly 60 extended to the outside of coaxial connector 20 forms the signal output end of the coaxial connector 20.

As shown in FIG. 5, when the complete set of the first conducting rod assembly 60 is installed in the first cylindrical chamber 32 of the housing 30, the movable cylinder 61 and the fixed cylinder 62 of the first conducting rod assembly 60 are pushed by the spring 63 to move in outward direction, and stopped by the electric conducting block 50 and the first sealing support 71 on both ends. Since the sliding support 40, the first sealing support 71 and the third sealing support 73 all are electric insulation parts, the electric conducting passage formed by the cylindrical wall of the fixed cylinder 62, the spring 63, the cylindrical wall of the movable cylinder 61 and the electric conducting block 50 can enable a good electrical connection between the conducting rod 621 of the first conducting rod assembly 60 and the contact piece 80, and will not any cause electric connection with the housing 30.

As shown in FIGS. 4 and 5 again, the second conducting rod assembly 90 comprises as conducting rod 91 and a spring 95. The conducting rod 91 is formed into step-wised shape which comprises an electric conducting pin 92, a neck portion 93 and push rod 94. The spring 95 is mounted on the push rod 94 of the conducting rod 91 with one end stopped by the neck portion 93.

When the second conducting rod assembly 90 is installed in the second cylindrical chamber 33 of the house 30, the push rod 94 of the second conducting rod assembly 90 can freely extend into the sliding center hole 42 of the sliding support 40, so that one end of the second conducting rod 90 can be supported by sliding support 40. However, one of the example of the preferred embodiment of the invention is having a bearing piece 74 with a center hole 741 tightly installed inside the second cylindrical chamber 33 and tightly fitted against the circular rib 31 to allow the push rod 94 of the second conducting rod assembly 90 to pass through and move freely in the center hole 741 of the bearing support 74, and extended into the sliding center hole 42 of the sliding support 40, i.e. the purpose of design of the bearing support 74 is to provide a support for one end of the second conducting rod assembly 90, and enable a more smooth movement of the push rod 94 of the second conducting rod assembly 90 inside the sliding center hole 42 of the sliding support 40.

In addition to having the push rod 94 of the second conducting rod 90 extended into the sliding center hole 42 of the sliding support 40 the electric conducting pin 92 of the second conducting rod assembly 90 is arranged to pass through the center hole 721 and enter into the inner side 722 of the second sealing support 72 which is tightly installed and fitted into the sealing portion 35 of the second cylindrical chamber 33 of the housing 30 so that through supporting the electric conducting pin 92 the other end of the second conducting rod assembly 90 can be supported by the second sealing support 72.

As shown in FIG. 5, when the complete set of the second conducting rod 90 is installed in the second cylindrical chamber 33 of the housing 30, one end of the spring 95 of the second conducting rod assembly 60 will touch and stopped by the neck portion 93 while another end will touch and stopped by the sealing support 74, or, in case there is no sealing support 74 installed inside the second cylindrical chamber 33, the other end of the spring 95 will touch and stopped by the sliding support 40, so that the spring 95 will exert an expansion force on the neck portion 93 of the second conducting rod assembly 90 that pushes the neck portion to press the second sealing support 72 constantly without separation, and the electric conducting pin 92 of the second conducting rod assembly 90 forms the signal input end of the coaxial connector 20.

Particularly, when the neck portion 93 of the second conducting rod assembly 90 securely touches and is stopped by the second sealing support 72, the push rod 94 of the second conducting rod assembly 90 is inside the sliding center hole 42 of the sliding support 40, and will cause no electrical connection with the center rod 611 of the first conducting rod assembly 60, this is because while in this condition there is a space between the push rod 94 and the center rod 611.

Figure 6:
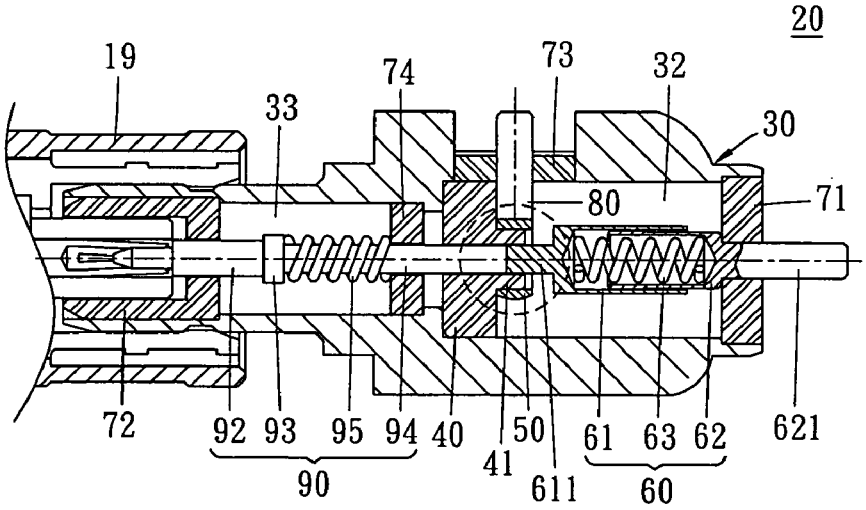
FIG. 6 is the sectional view along the longitudinal axis of the coaxial connector of the invention connected to a complementary connector showing that the coaxial connector of the invention possesses the function of switching the direction of signal transmission through the coaxial connector of the invention.

However, as shown in FIG. 6, when the electric conducting pin 92 of the second conducting rod assembly 90 is pushed axially by a force from outer side, and moves backwardly, the distance of moving of the push rod 94 of the second conducting rod assembly 90 in the sliding center hole 42 of the sliding support 40 will not only enable the push rod 94 to touch the center rod 611 of the first conducting rod assembly 60 but also push the movable cylinder 61 and the spring 63 of the first conducting rod assembly 60 to move jointly in backward direction, this will cause the movable cylinder 61 of the first conducting rod assembly 60 to move a short distance away from the electric conducting block 50 that results in a gap formed between the movable cylinder 61 and the electric conducting block 50, therefore the conducting rod 621 of the first conducting rod assembly 60 and the contact piece 80 will no longer form electrical connection, but the cylinder wall of the fixed cylinder 62, the spring 63, the center rod 611 of the movable cylinder 61 and the push rod 94 of the first conducting rod assembly 60 form an electric circuit that forms good electrical connection between the conducting rod 621 of the first conducting rod assembly 60 and the electric conducting pin 92 of the second conducting rod assembly 90 without causing electric connection with the housing 30.

Therefore, as shown in FIGS. 5 and 6, when the coaxial connector 20 of the invention is not connected to a complementary connector 19, the conducting rod 621 of the first conducting rod assembly 60 and the contact piece 80 form electrical connection, and signal can be transmitted from the contact piece 80 to the conducting rod 621 of the coaxial connector 20.

However, when the coaxial connector 20 of the invention is connected to a complementary connector 19, the conducting rod 621 and the contact piece 80 will no longer form electrical connection, but the conducting rod 621 of the first conducting rod assembly 60 and the electric conducting pin 92 of the second conducting rod assembly 90 will form electrical connection, signal can be transmitted from the complementary connector 19 to the conducting rod 621 through the electric conducting pin 92 of the coaxial connector 20. Therefore, the coaxial connector 20 of the invention has the function of switching the direction of transmission of signal without distortion of signal.

What is claimed is:

1. A coaxial connector comprising a housing which has a first cylindrical chamber and a second cylindrical chamber which are connected to each other, and an outlet opening connected to the first cylindrical chamber, wherein the first cylindrical chamber has a first sealing support carrying a center hole installed on the outlet of the chamber, a sliding support, an electric conducting block and a first conducting rod assembly which are installed inside the chamber;

the second cylindrical chamber has a second sealing support carrying a center hole installed on an outlet of the second chamber, and a second conducting rod assembly installed inside the second chamber;

the outlet opening has a third sealing support carrying a center hole installed as a cover of the opening, and has a contact piece installed through the center hole of the third sealing support with a front part of the contact piece extended to the outside of the housing forming the signal input end;

characterized in that the sliding support is fixed inside the first cylindrical chamber and has a raised hub on one side and a sliding center hole;

the electric conducting block has a mounting hole through which the electric conducting block is installed on the raise hub of the sliding support, and electric connection is formed between the top side of the electric conducting block and the contact piece;

the first conducting rod assembly has an elastic restoring mechanism formed jointly by a movable cylinder, a fixed cylinder and a spring wherein the movable cylinder has a center rod which is mounted and freely move inside the sliding center hole of the sliding support, and the fixed cylinder has a conducting rod which is arranged to pass through the center hole of the first sealing support, and extends to the outside of the housing to form the signal output end;

the second conducting rod assembly comprises a conducting rod and a spring wherein the conducting rod is formed into step-wised shape having an electric conducting pin, a neck portion and a push rod with an arrangement of having the spring mounted on the push rod of the conducting rod with one end stopped by the said neck portion; the electric conducting pin passes through the center hole of the second sealing support forming another signal input end, and the push rod of the conducting rod is mounted, and freely move inside the sliding center hole with its neck portion pushed by the spring force to keep a constant contact with the side surface of the second sealing support so that the push rod of the second conducting rod assembly and the center rod of the first conducting rod assembly which are mounted in and freely move inside the sliding center hole of the sliding support will not form electric connection and will be kept apart from each other a small distance.

2. The coaxial connector according to claim 1, wherein the electric conducting block and the contact piece are formed into a whole-piece structure.

3. The coaxial connector according to claim 1, wherein a bearing support is further installed inside the second cylindrical chamber, and the push rod of the second conducting rod assembly is arranged to pass through the center hole of the bearing support and extend into the sliding center hole of the sliding support.

4. The coaxial connector according to claim 2, wherein a bearing support is further installed inside the second cylindrical chamber, and the push rod of the second conducting rod assembly is arranged to pass through the center hole of the bearing support and extend into the sliding center hole of the sliding support.

* * * * *